US006332707B1

(12) United States Patent
Yamada

(10) Patent No.: US 6,332,707 B1
(45) Date of Patent: Dec. 25, 2001

(54) KNEADER

(75) Inventor: Kazuie Yamada, Saitama (JP)

(73) Assignee: Maeda Corporation, Tokyo (JP)

( * ) Notice: Subject to any disclaimer, the term of this patent is extended or adjusted under 35 U.S.C. 154(b) by 0 days.

(21) Appl. No.: 09/719,163

(22) PCT Filed: Oct. 22, 1998

(86) PCT No.: PCT/JP98/04793

§ 371 Date: Dec. 12, 2000

§ 102(e) Date: Dec. 12, 2000

(87) PCT Pub. No.: WO00/13778

PCT Pub. Date: Mar. 16, 2000

(30) Foreign Application Priority Data

Sep. 2, 1998 (JP) ..... 10-248705

(51) Int. Cl.[7] ..... B01F 5/24; B01F 13/00

(52) U.S. Cl. ..... 366/336; 366/9; 366/183.1; 366/341

(58) Field of Search ..... 366/9, 154.1, 158.5, 366/183.1, 183.2, 336, 341

(56) References Cited

U.S. PATENT DOCUMENTS

| | | | | |
|---|---|---|---|---|
| 670,222 | * | 3/1901 | Campbell | 366/336 |
| 694,575 | * | 3/1902 | Ransome | 366/9 |
| 846,751 | * | 3/1907 | Melvin | 366/9 |
| 5,947,600 | * | 9/1999 | Maede et al. | 366/336 |

FOREIGN PATENT DOCUMENTS

| | | | | |
|---|---|---|---|---|
| 25 08 482 | * | 1/1976 | (DE) | 366/336 |
| 0 796 650 | * | 9/1997 | (EP) | 366/336 |
| U-59-115424 | | 8/1984 | (JP) . | |
| U-5-80526 | | 11/1993 | (JP) . | |
| A-9-253467 | | 9/1997 | (JP) . | |
| 9-276679 | * | 10/1997 | (JP) | 366/336 |

* cited by examiner

*Primary Examiner*—Tony G. Soohoo
(74) *Attorney, Agent, or Firm*—Arent Fox Kintner Plotkin & Kahn, PLLC

(57) ABSTRACT

An object of the present invention is to provide a kneader capable of improving both of its kneading and mixing functions, irrespective of a horizontal arrangement or a vertical arrangement, with a comparatively simple design not to degrade the workability thereof. To attain the object of the invention, a kneader adapted to knead an object material by passing it through a plurality of irregular passages (22, 23), each having a sectional shape varied, from an inlet port thereof toward an outlet port thereof, comprising a kneader body (20) having a material supply port (20*a*) at one end thereof, a material discharge port (20*b*) at the other end thereof and a plurality of irregular passages communicating with the supply port (20*a*) and the discharge port (20*b*), and supply means (10) for supplying the object material to the kneader body. The sectional shape of each of the irregular passages (22, 23) of the kneader body (20) is varied progressively from an inlet port (22*a*) toward an outlet port (22*b*). The irregular passages (22, 23) are provided between the inlet ports and outlet ports thereof with means (25,28) for merging and dividing the object material, which passes through the irregular passages.

5 Claims, 7 Drawing Sheets

KNEADER

TECHNICAL FIELD

The present invention relates to a technology of a kneader for kneading a fluidized object material by passing it through irregular passages having varied sectional shapes, and more particularly, to a technology of a kneader for kneading the material by repeatedly merging and dividing the material by applying compression force and shearing force to the object material, while changing the sectional shape of the object material itself.

BACKGROUND ART

In many cases, the more the material that needs kneading such as mortar, concrete or ground material is kneaded, the better the properties or the characteristics or physical properties thereof become. Accordingly, in case of such an object material, a sufficient kneading work will be needed.

In noticing the conventional kneading method, there are mixers (kneaders) such as an arm type, shell type, and roll type according to the kneading system. Since these kneaders perform the work mechanically, any type of them may be suitable for kneading a large amount of material.

However, although such a conventional kneader is surely effective depending on the material to be kneaded, it is known that such a kneader is not so effective when consideration is given from the standpoint of energy or time needed for kneading.

Also, since any of the mixers (kneaders) such as the arm type, shell type, and roll type which have been frequently used conventionally have mechanical parts that are movable, the wear or damage is likely to occur correspondingly. Furthermore, the apparatus itself is relatively costly. These points are remarkable particularly in the case where the mortar or concrete containing particles such as fine aggregate or coarse aggregate is used as the object material in the field of construction and civil engineering.

Therefore, in view of such problems, the applicant has already proposed the invention of the kneading method and the kneading apparatus as described in Japanese Patent Laid-Open Publication No. 9-253467. This is the technology for kneading a fluidized object material by passing it through a plurality of irregular passages having varying sectional shapes.

Namely, as shown in FIG. 7, used in this technology is a kneader body 30 in which sectional shapes of the irregular passages 1 and 2 are changed continuously from an inlet to an outlet. Then, the object material is pressurized and fed from the inlet of each irregular passage 1, 2 of this kneader body 30. As a result, the object material is layered in a stratified manner. The compression force and the shearing force are applied to the material, and then, the material is rolled and layered. Again, the compression force and the shearing force are applied to the material to repeat the rolling and layering to thereby knead and mix the material.

The kneader body 30 used here comprises a plurality of elements 31, 31 connected in series in a direction of the irregular passages 1, 2, each element 31 being provided with a plurality of irregular passages 1, 2 arranged in parallel. The inlet port of each irregular passage 1, 2 is on one end of the element 31 and the outlet port thereof is on the other end of the element 31. The adjacent elements 31 are connected in such a manner that the inlet port of the element 31 on one side intersects the outlet port of the element 31 on the other side so that the merging and dividing of the object material may be performed at the connection portion. The merging and dividing are performed by partitions 3, 4 between the irregular passages 1, 2.

An n-number of elements 31 are connected to one another so that the object material becomes stratified corresponding to the n-power of 2 at the outlet, thereby obtaining an excellent kneading efficiency. If the thirty elements 31 are connected to one another, the kneading corresponds to the kneading of as many times as about one billion ($=2^{30}$) times. The connection of the elements 31 is performed by utilizing a flange F with bolt holes f1 at each end of each element.

In the case where such a kneading technology is adopted, it is possible to knead effectively the object material by applying the compression force and the shearing force, while changing the sectional shape of the object material itself. Also, the merging step and the dividing step are repeated for kneading the object material thereby the efficiency of kneading can be enhanced highly. In addition, it is possible to obtain such an advantage to omit the directly movable portions to thereby prevent the wear or damage.

The inventors of the present application have vigorously studied for further improvements of this kneading technology, and, as a result, they have found that there are still problems to be solved in the following points (1) to (3).

(1) In the kneading method in which the object material is pressurized and fed, an extremely good result may be obtained, but in the case where the idea of mixing by utilizing the gravitational force of the object material is adopted, that is, as shown in FIG. 8(*a*) the method in which the kneader body 30 is arranged vertically and the object material is caused to fall by the gravitational force for mixing is adopted, there is a problem particularly in the point of mixing efficiency. This is because, if the material for concrete, ground material or the like is fed as the object material, and when the material is passed through the kneader body 30, the merging and dividing are repeated for kneading as the fed material passes from above downwardly through the irregular passages 1, 2 of each element 31. However, as shown in FIGS. 8(*b*) to 8(*e*), a phenomenon occurs due to the structural feature of the elements that the material passing through plus(+) and minus(−) regions are pulled straightly through these regions, in any case. For this reason, as shown in FIG. 8(*f*), such a phenomenon is liable to occur that the material C after having been mixed is concentrated at plus (+) and minus (−) regions in two piles and the portion of material having a large diameter is rolled out to the lower portion of the piles.

(2) It has been found that such a phenomenon occurs similarly even in the case of kneading the concrete. Namely, it has been found that simply with the vertical arrangement, it is insufficient to apply the compression force and the shearing force to the object material and to effectively knead the material. Accordingly, in the case where the vertical arrangement utilizing the gravitational force is used, there is room for further enhancing the kneading efficiency.

(3) As a result of reviewing the causes of the above-described points (1) and (2), in detail, it is found that, as shown in FIG. 7, in the case where a plurality of elements, each including two irregular passages 1 and 2, are connected to one another, both the mixing function and the kneading function become lower than the theoretical functions. Namely, in the arrangement where the plurality of elements, each having three or four or more irregular passages, are connected to one another, almost no through-passage through which the object material is pulled straightly is formed in the kneader body 30, and the substantially theoretical functions may be obtained. Accordingly, also in the cases where the elements, each having two irregular passages, are used, it is necessary to adopt some approach, in order not to reduce the functions. In particular, this is because, in the element having the two irregular passages, the structure itself is comparatively simple and the workability is good thereby to provide a high usable property.

Note that the technology disclosed in Japanese Patent Publication No. 53-27024 (post examination publication) proposes a mixer of granular material. This is directed to an idea of arranging the mixer in a vertical direction and mixing by utilizing the fall of the granular material by the gravitational force thereof. This mixer also has the problem that the straight through-passage is formed and the above-described theoretical mixings effect could not be obtained. Of course, in the technology disclosed in this publication, there is no idea of feeding the material under pressure to apply the compression force and the shearing force for kneading.

DISCLOSURE OF THE INVENTION

In order to solve the above-described problems, an object of the present invention is to provide a kneader capable of improving both of its kneading and mixing functions, irrespective of a horizontal arrangement or a vertical arrangement, with a comparatively simple design, yet not to degrade a workability.

According to the present invention, there is provided an apparatus for kneading an object material by passing it from an inlet to an outlet of each of a plurality of irregular passages having varying sectional shapes, characterized by comprising: a kneader body having a supply port at one end for supplying the object material and a discharge port at the other end, and having the plurality of irregular passages in communication with the supply port and the discharge port, and material supply means for feeding the object material to the kneader body.

Each irregular passage of the kneader body has its sectional shape varying progressively from the inlet to the outlet. Then, merging and dividing means for merging and dividing the object material passing through each irregular passage is provided between the inlet and the outlet of each irregular passage.

Furthermore, a direction of each irregular passage is changed with respect to the other passage so as to eliminate the presence of a straight through-passage extending from the inlet to the outlet. Then, a diameter of the discharge port of the kneader body is set to be smaller than a diameter of the supply port.

With such a structure, there is no portion where the object material is passing straightly through the kneader body, and it is possible to obtain the kneading efficiency that is substantially the same as the theoretical efficiency to remarkably enhance the kneading efficiency. Also, because of the structure for changing the direction of the irregular passages, it is possible to avoid the adverse affect to the workability. Furthermore, since the diameter of the discharge port is set to be smaller than the diameter of the supply port, the discharge port is in a throttled state. Correspondingly, the amount of discharged material is decreased. As a result, the material is fluidized in a state where each irregular passage is filled with the material. Thus, the kneading efficiency is further improved.

The apparatus body may be so structured that the kneader body includes different kinds of first and second elements connected alternatively in a direction of the irregular passages, each element having a plurality of irregular passages arranged in parallel, and the irregular passages of the first element and the irregular passages of the second element different in varying the sectional shapes and direction of the irregular passages.

The two different kinds of elements having the different directions of the irregular passages and different sectional shapes thereof, are used by connecting them, and therefore, it is possible to eliminate the straight through-passages, thereby to improve the kneading efficiency.

It is most preferable that the first element and second element, each having two irregular passages; each irregular passage of the first element is so configured that a sectional shape of the outlet is in a state of being rotated through about 90 degrees to either one of the axial directions of the first element relative to the sectional shape of the inlet; and each irregular passage of the second element is so configured that a sectional shape of the outlet is in a state of being rotated through about 90 degrees in the opposite direction to the first element relative to the sectional shape of the inlet.

Thus, by changing the rotational (twist) direction of the outlet relative to the inlet of the irregular passage between the elements, it is possible to readily and positively avoid the formation of the straight through-passage.

The material supply means may be structured to have a function for pressurizing and feeding the object material to the kneader body. In this case, the material supply means may include a hopper connected to the inlet port located at the top of the kneader body arranged vertically with the discharge port located at the bottom, and a conveyor for transporting the object material to the hopper.

With this structure the object material is pressurized and fed by the weight of thereof to be reserved in the hopper.

Also, the discharge port of the kneader body may be formed of a throttle member connected to the outlet of the irregular passage of one of the first and second elements located at the lowermost end or in the rearmost stage.

In this case, it is most preferable that the throttle member is formed in a cylindrical shape and having a tapered sectional area in a direction from an opening at one end to an opening at the other end thereof; the opening at the one end is connected to the side of the irregular passage of the element located at the lowermost end or the rearmost stage; and the opening at the other end is opened to form the discharge port.

Because by providing the throttle member as a separate and discrete member it is possible to form the discharge port having the throttle function without adversely affecting the workability or the structure of the elements.

BEST MODE FOR CARRYING OUT THE INVENTION

Preferred embodiments of the present invention will now be described with reference to FIGS. 1 to 6 of the accompanying drawings.

First Embodiment

A structure of a kneader schematically shown in FIG. 1 will first be described. In this embodiment, there are provided a kneader body 20 arranged in vertically, a hopper H connected to an upper portion of the kneader body 20, and a belt conveyor K for feeding an object material to the hopper H. In this embodiment, the hopper H and the belt conveyor K constitute material supply means 10.

Next, detailed description thereof will be made.

The hopper H has a large size capable of reserving a large quantity of the object material to be caused to flow downwardly through the kneader body 20. The reason for this is that the object material is caused to flow downwardly through the kneader body 20 under a pressure by utilizing the weight of the object material itself in the hopper H. In view of this point, the hopper H is connected directly to the upper portion of the kneader body 20.

Figure 1:
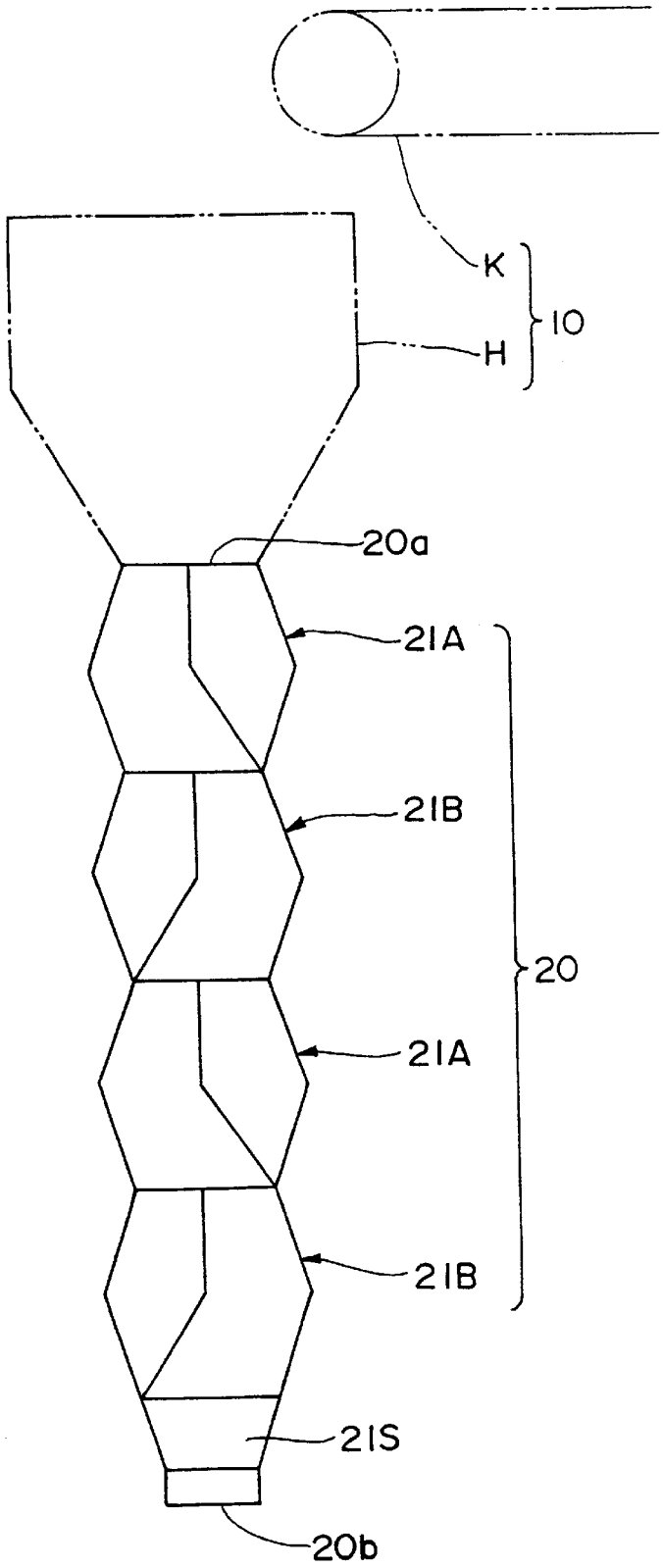
FIG. 1 is a front view showing an overall structure of a kneader in accordance with a first embodiment of the present invention.

The connection structure between the hopper H and the kneader body 20 is not particularly shown in FIG. 1. However, the existing method, such as, a connecting method using flanges provided on both sides or a welding method, may be used.

Also, a discharge port (an outlet) 20*b* is provided at a lower portion of the kneader body 20. This discharge port 20*b* is formed to be smaller than a material supply port (an inlet) 20*a* for feeding the material to the kneader body 20. This is includes a so-called throttle member 21S provided at the outlet, and the object material is caused to flow downwardly in a state that the kneader body 20 is filled with the object material.

Figure 2:
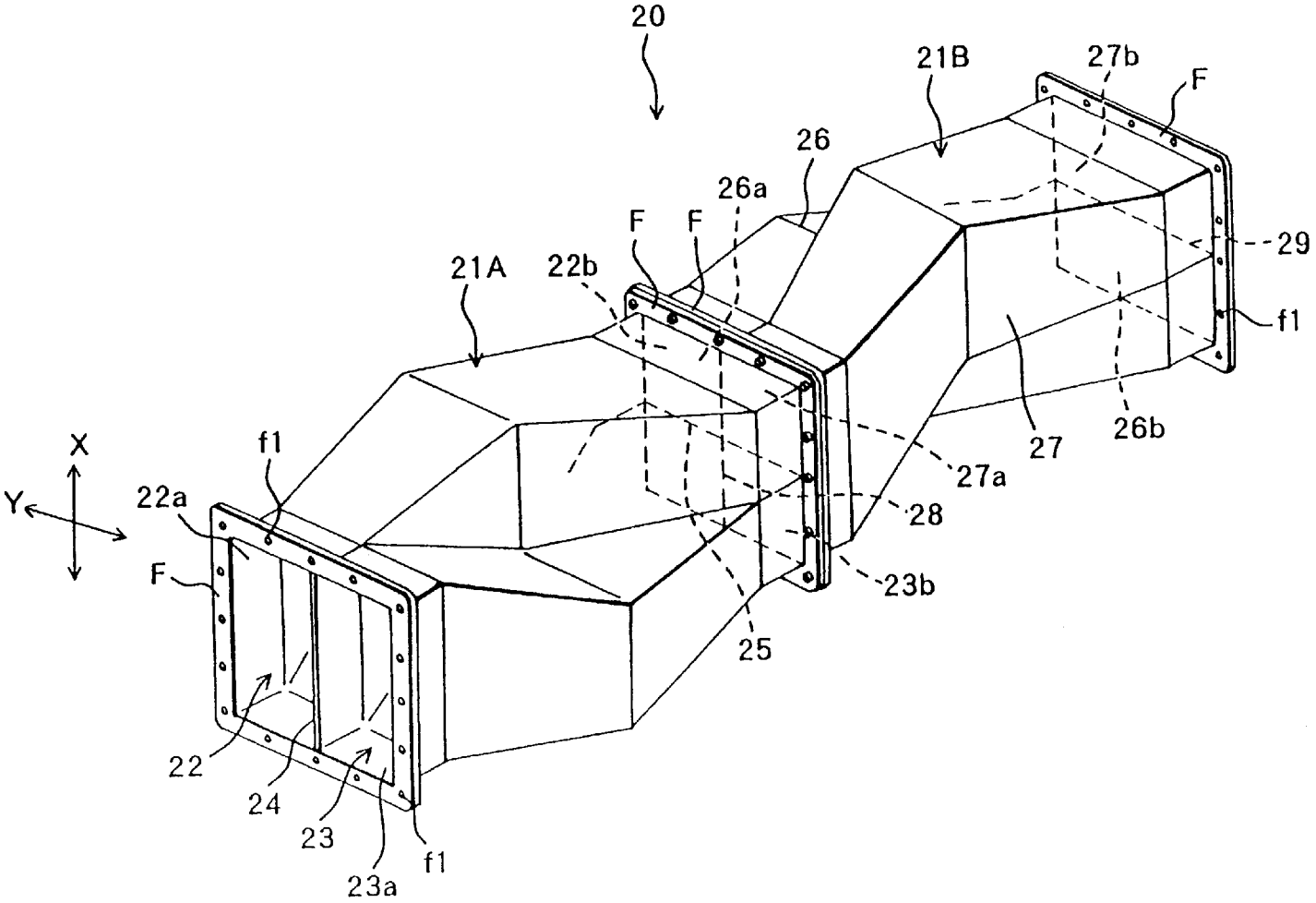
FIG. 2 is a partial perspective view showing a structure of a kneader body of a vertical kneader in accordance with the first embodiment of the present invention.

Basically, the apparatus body 20 is structure in such a manner that two kinds of four, in total, elements 21A and 21B are connected alternately in the vertical direction. Of course, the number of elements to be connected maybe increased according to the necessity. For the sake of convenience, FIG. 2 shows the state where the two kinds of elements 21A and 21B are connected alternately.

The specific structure of each element 21A, 21B will be described. First, one kind of elements (first elements) 21A each having both ends in a square shape. Flanges F are formed at the ends for connecting the elements at the ends.

A plurality of bolt holes f1 are formed in these flanges F, F. The adjacent elements are fixedly connected to each other by means of bolts at the ends by utilizing the bolt holes f1. It is therefore preferable that the above-described throttle member 21S is connected using the flanges F. For example, a structure having a flange with bolt holes also provided at the upper end of the throttle member 21S may be adopted. Of course, a welding structure may also be adopted.

The specific shape of the throttle member 21S will be described in more detail. The throttle member 21S is formed in a tapered cylindrical shape as a whole except the connecting portion (for example, connecting flange) with the element 21B. Namely, this throttle member 21S is formed in a tapered shape with the sectional area thereof decreased gradually from an opening at one end (upper end) thereof toward an opening at the other end (lower end). The opening at the one end is connected to the end of the outlet of the element 21B located at the lowermost end, and the opening at the other end is opened to form the discharge port 20*b*.

The element 21A is provided with two irregular passages 22, 23 arranged in parallel in the same direction. A partition wall 24 is formed in the center of one end of this element 21A so as to form the longitudinal openings on the right and left side.

These right and left longitudinal openings serve as inlet ports 22*a*, 23*a* of the two irregular passages 22, 23, respectively.

A partition wall 25 is provided in the center of the other end of the element 21A so as to form the horizontally extending openings at the upper and lower sides. The horizontally extending upper and lower openings serve as outlet ports 22*b* and 23*b* of the two irregular passages 22, 23, respectively. Namely, the partition wall 24 at the inlet end of the element 21A and the partition wall 25 at the outlet end of the element 21A are disposed in different directions to 90 degrees from each other.

Arm Accordingly, the arrangement pattern of the two inlet ports 22*a*, 23*a* of the irregular passages 22 and 23 is such that the rectangular openings are formed in parallel on the right and left sides, whereas the arrangement pattern of the two outlet ports 22*b*, 23*b* is such that the rectangular openings are formed in parallel on the upper and lower sides. The specific shape of the irregular passages 22, 23 will be described. The respective irregular passages 22, 23 are arranged with their sectional shapes being continuously varied toward the outlet ports 22*b*, 23*b* from the inlet ports 22*a*, 23*a*.

Regarding the state of variation, each of the irregular passages 22, 23 has its sectional area constant at any position from the inlet ports 22*a*, 23*a* to the outlet ports 22*b*, 23*b*, but only the shape of the section changes continuously. Namely, the inlet ports 22*a*, 23*a* have a longitudinal rectangular shape in an X-direction, the sectional shape is in a square at an intermediate portion between the inlet ports 22*a*, 23*a* and the outlet ports 22*b*, 23*b*, and the outlet ports 22*b*, 23*b* have a longitudinal rectangular shape in a Y-direction perpendicular to the X-direction (see FIG. 2). Then, the length of the irregular passages 22, 23 is same.

Accordingly, the object material passing through the respective irregular passages 22, 23 is caused to change its sectional shape gradually from the longitudinal rectangular shape in the X-direction to the square shape and further, to the longitudinal rectangular shape in the Y-direction. In this element 21A, as viewed in FIG. 2, the inlet port 22*a* located on the left side and the outlet port 22*b* located in the upper side are in communication with each other through the irregular passage 22, whereas the inlet port 23*a* located on the right side and the outlet port 23*b* located on the lower side are in communication with each other through the irregular passage 23.

Next, the other kind of elements (second elements) 21B have basically the same structure as that of the above-described element 21A. However, in this element 21B, as viewed in FIG. 2, an inlet port 26*a* located on the left side and an outlet port 26*b* located in the lower side are in communication with each other through an irregular passage 26, whereas an inlet port 27*a* located on the right side and an outlet port 27*b* located on the upper side are in communication with each other through an irregular passage 27. Namely, this element 21B has a different communication state between the inlet port and the outlet port of each irregular passage from that of the element 21A.

This communication state will be described specifically. The state of variation of the direction and the sectional shape of the irregular passages 26, 27 of the element 21B are different from that of the element 21A. In this respect, as is apparent from FIG. 2, the irregular passages 22, 23 of the element 21A are rotated in a direction in which they are twisted in a clockwise direction by 90 degrees toward the outlet port from the inlet port thereof, whereas the irregular passages of the element 21B are rotated in a direction in which it is twisted in a counterclockwise direction by 90 degrees. Then, since the twist directions of the irregular passages are thus different, the varying state of the sectional shape of the irregular passages 22, 23 is different from the varying state of the sectional shape of the irregular passages 26, 27.

FIG. 2 shows the state where such two kinds of elements 21A and 21B are connected alternately. Namely, in the above-described two kinds of elements 21A and 21B, the inlet end of the one element 21B is connected to the outlet end of the other element 21A with the flanges F in close contact with each other by bolts.

Accordingly, at the connecting portion between the two kinds of elements 21A and 21B, the outlet port 22*b* of the irregular passage 22 of the one element 21A is in communication with the half of the inlet port 26*a* of the irregular passage 26 of the other element 21B and the half of the inlet port 27*a* of the other irregular passage 27, whereas the outlet port 23*b* of the irregular passage 23 of the one element 21A is in communication with the rest half of the inlet port 26*a* of the irregular passage 26 of the other element 21B and the rest half of the inlet port 27*a* of the other irregular passage 27.

For this reason, each half of the object material that has passed through each irregular passage 22, 23 in the one element 21A is introduced into each irregular passage 26, 27 of the other element 21B to be merged substantially. However, with respect to the object material that has passed through one irregular passage, it is divided to each half at the connecting portion of the two elements.

Accordingly, each outlet port and each inlet port of each irregular passage formed in the outlet end and the inlet end that are the connecting portion between the two elements 21A, 21B constitute the merging and dividing means of the object material. As shown in FIG. 1, when such elements 21A and 21B are connected alternately in series, the merging and dividing means for the object material is formed in each connecting portion.

The operation of the thus constructed kneader will now be described.

The object material, for example, an aggregate and mortar that have been transported by the belt conveyor K are caused to continuously fall into the hopper H from the delivery end. The aggregate and mortar are kneaded roughly when they fall into the hopper H from the conveyor K, and they are, in that state, introduced into each irregular passage 22, 23 from the inlet ports 22*a*, 23*a* of the first element 21A of the kneader body 20. Then, they are kneaded while falling (flowing downwardly) through the kneader body 20 by the gravitational force.

Figure 3:
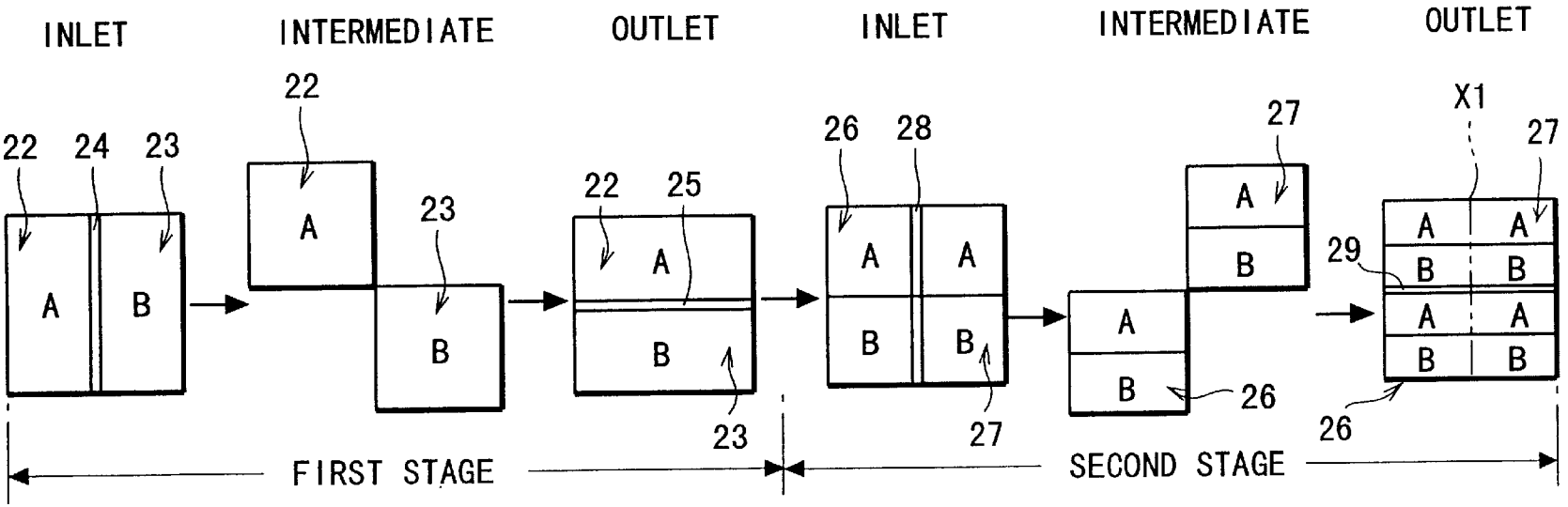
FIG. 3 is a schematic view of process steps showing in a model diagram manner a varying status of a section of an object material in a state that two elements are connected to each other.

The kneading process of the object material (aggregate and mortar) flowing downwardly through the kneader body 20 will now be described with reference to FIG. 3 showing the process diagram. The process diagram views shows in a model manner the changing state of the object material, i.e., the aggregate and mortar, in the regions of the inlet end, the intermediate portion and the outlet end of each element 21A, 21B in the case where the two elements 21A, 21B are connected to each other (in two stages).

As can be understood from FIG. 3, the object material fed into the hopper H is introduced into the two irregular passages 22, 23 at the inlet end of the first stage element 21A, and as a result, the flow thereof is divided into two, A and B. The sectional shape of each flow of fluidized object material thus divided is in the shape of a longitudinal rectangular shape in the X-direction.

Subsequently, at the intermediate portion in the first stage, the sectional shapes of the fluidized object materials A, B are both changed into a square shape. Further, the shapes are both changed into a rectangular shape long in the Y-direction at the outlet end, different by 90 degrees from the longitudinal direction X at the inlet end in the first stage. Accordingly, the sectional shape of each of the fluidized object materials A, B is changed from the rectangular shape long in the X-direction to the square shape, and to the rectangular shape long in the Y-direction.

During this varying process, the material is subjected to the continuous compression effect (compression force and shearing force) by the inner wall surface of each irregular passage 22, 23. As a result, a continuous convection phenomenon occurs in particular in a radial direction of the section in the flow of the fluidized object material, thereby the primary kneading is carried out.

Next, since a partition wall 28 at the inlet end of the second stage element 21B intersects perpendicularly with the partition wall 25 at the outlet end of the first stage element, and as shown in FIG. 3, the object materials A and B fed out of the outlet end of the first stage element 21A are divided into the right and left, respectively, that is, divided into A/B and A/B.

Then, the object materials A/B are caused to flow through the respective irregular passages 26 and 27. Namely, at the inlet end of the second stage element 21B, parts of the object materials A, B are merged and flowing into the respective irregular passages 26, 27, and the sectional shape of the fluidized the object material within each passage is formed into the rectangular shape long in the X-direction.

Subsequently, at the intermediate portion in the second stage, the sectional shapes of the fluidized object materials A/B are changed into the square shape as a whole and the shape is changed into the longitudinal rectangular shape in the Y-direction at the outlet end. Thus, in the second stage, the shape of the object material A/B is changed from the longitudinal rectangular shape in the X-direction to the square shape and into the longitudinal rectangular shape in the Y-direction.

Then, during the varying process, the material is subjected to the continuous compression effect (compression force and shearing force) by the inner wall surface of each irregular passage 26, 27. As a result, a continuous convection phenomenon occurs, particularly in a radial direction of the section in the fluidized object material thereby the secondary kneading operation is carried out.

With respect to a third stage, although not particularly shown, at the third stage inlet end, the final object material at the second stage outlet end shown in FIG. 3 is divided into the right and left sides and merged into A/B/A/B as shown by an added phantom line X1. Thereafter, the object material is kneaded in the same way as the first stage and the second stage.

Thus, the compression force and the shearing force are applied to the object material, and the material is rolled and layered by these forces, and again, the compression force and the shearing force are applied to the material, and rolling and layering of the material are repeated for kneading.

In such a kneading process, the object material is kneaded while falling through the kneader body 20 by the gravitational force. In this case, the object material within the kneader body 20 falls under the pressurized condition by the pressurizing effect based on the weight of the object material reserved within the hopper H and by the fact that the discharge port 20*b* is throttled. Thus, the object material falls downwardly while the kneader body 20 is filled with the object material. As a result, the above-described compression force and the shearing force are effectively applied to the object material.

In this connection, as described in the Background Art Section, in the kneading method for causing the material to simply fall through the kneader body 30 of the prior art, since the object material falls under the condition that the kneader body is not filled with the object material, it is hard to apply the compression force or the shearing force that is needed for kneading. Therefore, the prior art kneading method is suitable for mixing rather than kneading. In contrast thereto, according to this embodiment, it is possible to solve such problems, thereby the technology can be regarded as suitable for kneading. Of course, the technology can be utilized in the case where the granular material or the fluidized material is to be mixed. In such a case, more effective mixing can be performed.

Figure 4:
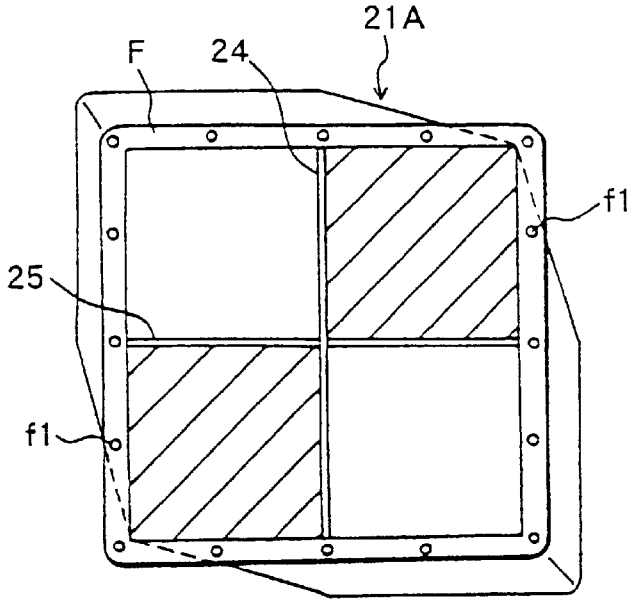
FIG. 4 is a plan view showing a state of irregular passages of a different kind of element (first element)

Note that in this embodiment, as described above, the two different kinds of elements 21A and 21B are connected alternately. The reason therefor will now be described. Each irregular passage of the element 21A shown in FIG. 2 is viewed from one end, and the portion, except the hatched regions shown in FIG. 4, is observed as a through-passage, i.e., a straight passage.

Since the inlet port 22*a* on the left side in the inlet end is in communication with the upper outlet port 22*b* in the outlet end, and the inlet port 23*a* on the right side in the inlet end is in communication with the lower outlet port 23*b* in the outlet end as described above, it is natural that the regions where these portions are partially overlapped with each other may be seen directly from the inlet port to the outlet port.

Then, with respect to the passage portion that is present in the regions where the inlet ports 22*a*, 23*a* and the outlet ports 22*b*, 23*b* are partially overlapped with each other when viewed in the longitudinal direction of the element 21A, as far as the fluidized object material falls simply by its gravitational force without filling the passage portion, the material is caused to pass with almost no change of its shape. Then, even if the plurality of elements 21A having the same shape are connected, the state of the irregular passage as viewed from the end is not different from the state shown in FIG. 4 at all. Accordingly, it can be predicted that the kneading effect cannot be attained by simply connecting the plurality of elements having the same shape.

Figure 5:
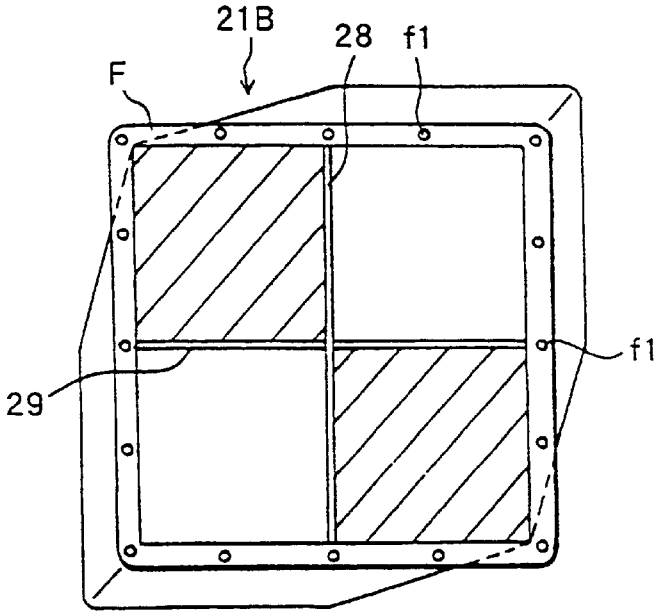
FIG. 5 is a plan view showing a state of irregular passages of a different kind of element (second element)

On the other hand, with respect to the element 21B, for the same reason as described above for the element 21A, the region where the inlet ports 26*a*, 27*a* and the outlet ports 26*b*, 27*b* are overlapped with each other is the portion, except the hatched portions, shown in FIG. 5. This is apparent, because unlike the element 21A, the inlet port 26*a* on the left side in the inlet end is in communication with the lower outlet port 26*b* in the outlet end and the inlet port 27*a* on the right side in the inlet end is in communication with the upper outlet port 27*b* in the outlet end.

Therefore, assuming that these two kinds of elements 21A, 21B are connected as shown in FIG. 2, and when the irregular passages are viewed from the inlet end, the observed state would be as if FIGS. 4 and 5 were overlapped. As a result, it is impossible to directly see the outlet port from the inlet port. This means that the object material that has been fed from the inlet port would not flow to the outlet port in a so-called straight manner. As a result, it is possible to further enhance the kneading effect. This effect is effectively applied, particularly at the time of flow-down by the gravitational force in the initial stage of the kneading under the condition that the passages are not yet filled with the object material.

Note that the elements used in the above-described embodiment are, each provided with the two irregular passages 22, 23 or 26, 27. However, the kneader body may be structured by connecting the elements, each having three or more irregular passages.

Second Embodiment

Figure 6:
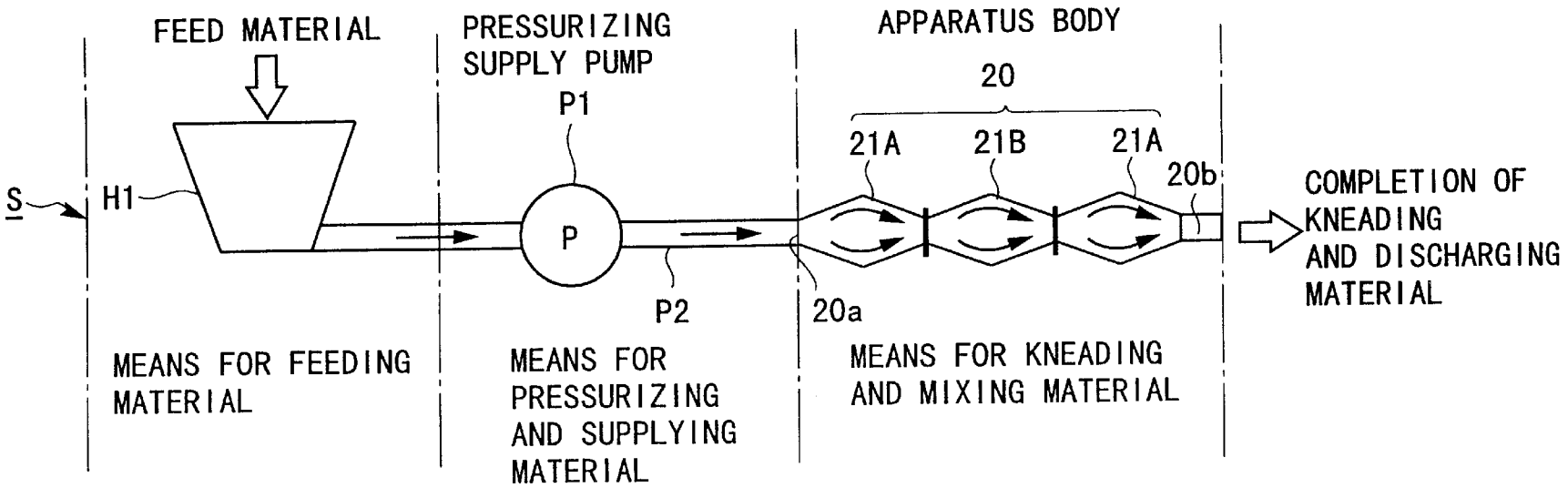
FIG. 6 is a front view showing an overall structure of a kneader in accordance with a second embodiment of the present invention.
Figure 7:
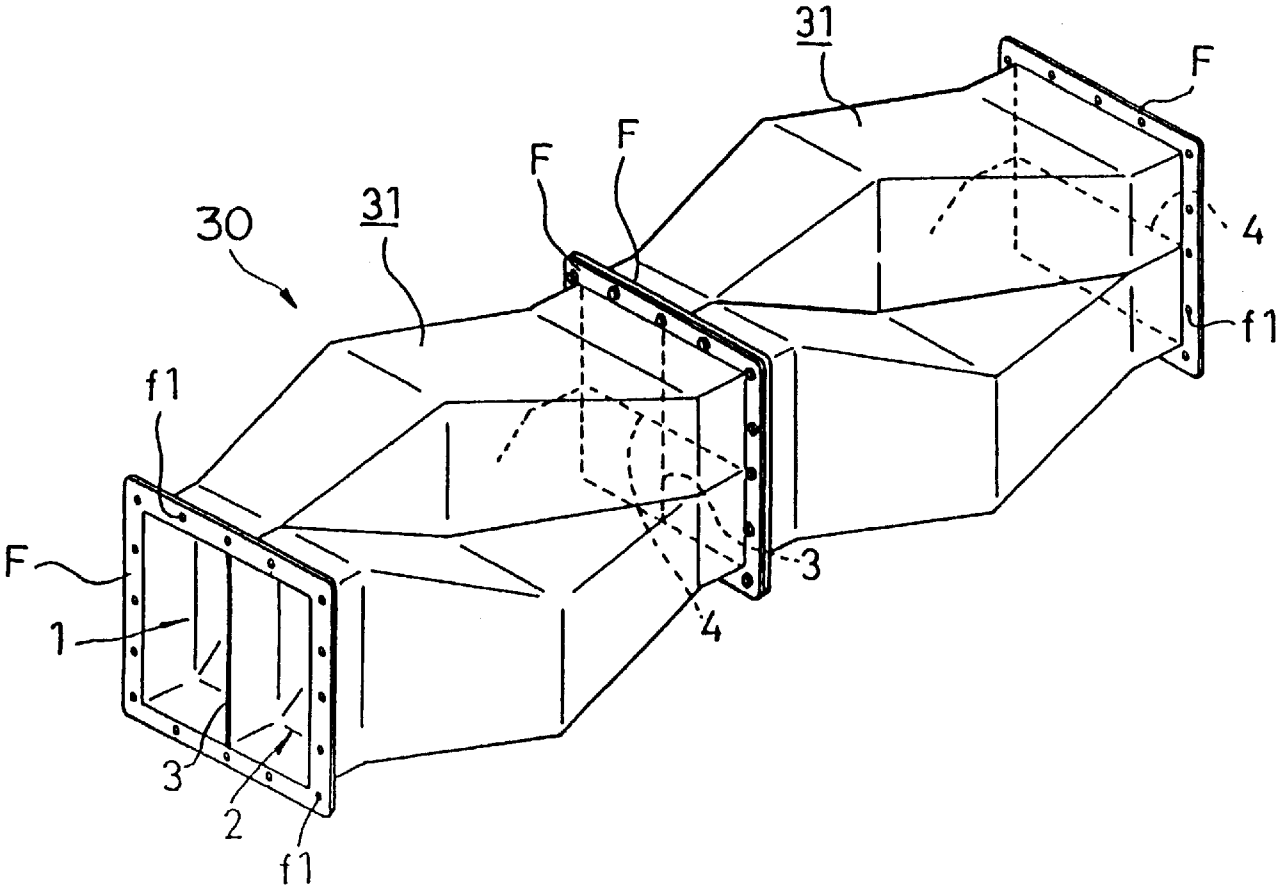
FIG. 7 is a perspective view showing a kneader body in a state that two conventional elements are connected to each other.
Figure 8A:
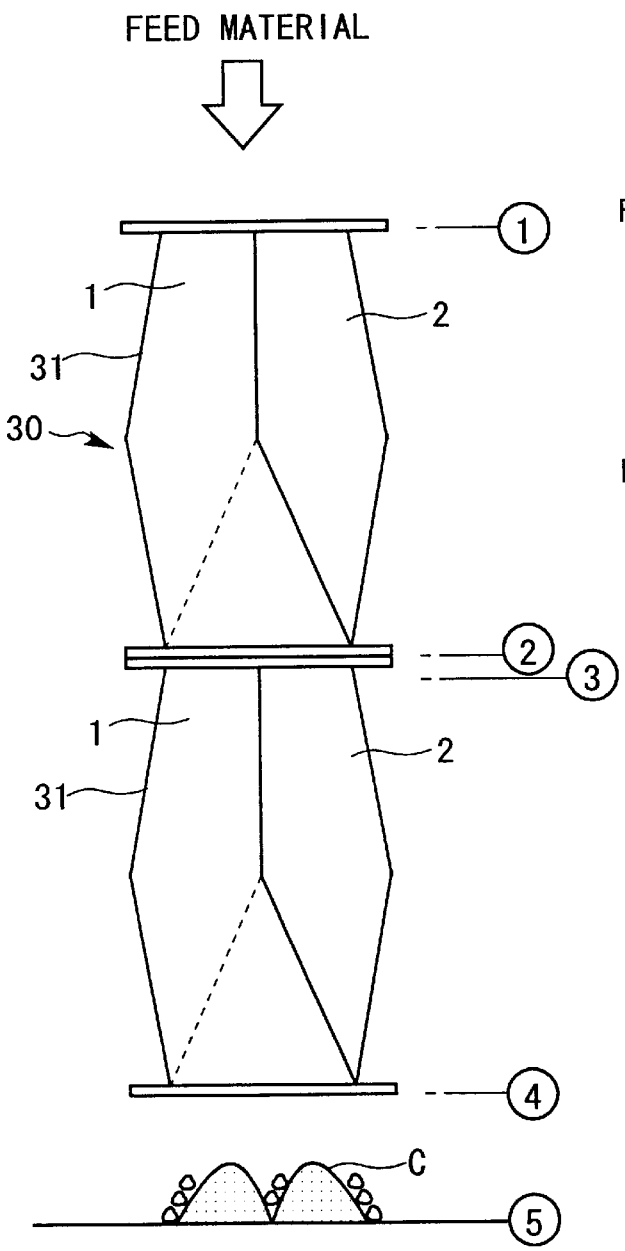
FIG. 8 is a diagram explaining the problems of a vertical kneader; wherein (a) is a front view of the kneader body, (b) to (e) are sectional views corresponding to ① to ④ of (a), and (f) is a plan view corresponding to ⑤ of (a).
Figure 8B:
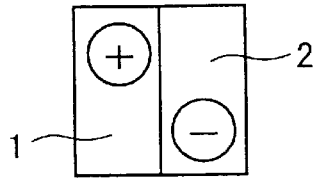
Figure 8C:
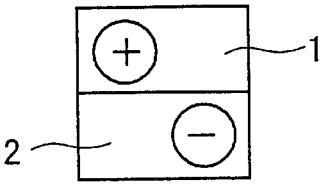
Figure 8D:
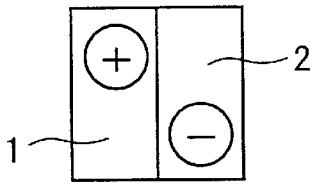
Figure 8E:
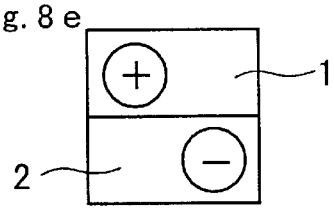
Figure 8F:
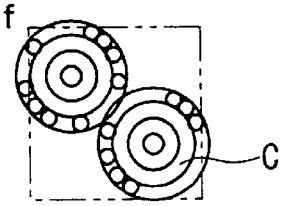

FIG. 6 is a schematic structural diagram showing a kneader in accordance with a second embodiment of the present invention. In this embodiment, the kneader body 20 is arranged in a horizontal direction, and the object material is fed into the kneader body 20 by using pressurizing supply means for supplying the object material for kneading.

Namely, the kneader S is provided with material supply means, a material pressurizing supply means and material kneading and mixing means. The material supply means comprises a hopper H1 for reserving the material which has been adjusted to have a suitable fluidizing property by temporarily mixing, in advance, as needed in the case where the object material is the concrete or the mortar, and the material is supplied to the material pressurizing supply means. The pressurizing supply means comprises, for example, a pressurizing supply pump P1 for concrete or the like for pressurizing and feeding the object material to the material kneading and mixing means (kneader body 20) through a connecting pipe P2.

In the same manner as in the case of the kneader body 20 shown in the first embodiment, the kneader body 20 is structured such that two kinds of elements 21A, 21B, having the irregular passages twisted in different directions, are alternately connected in series (see FIG. 2). For the sake of convenience, FIG. 1 shows the structure where the two elements 21A and a single element 21B are connected.

The object material is kneaded by passing through the elements 21A, 21B of the kneader body 20 continuously and discharged from a discharge port 20*b*. A diameter of the discharge port 20*b* is set to be somewhat smaller than a diameter of the inlet port 20*a* of the kneader body 20.

In the case where the kneader S is structured as above, in particular, since the object material is pressurized and fed into the kneader body 20 by the pressurizing supply pump P1, the object material is subjected to the compression force and the shearing force corresponding to the pressure in the kneader body 20. Furthermore, the throttle effect works due to the presence of the discharge port 20*b* having the smaller diameter.

Accordingly, the object material is caused to flow toward the discharge port 20*b* under the condition that the kneader body 20 is filled with the object material. Then, in the fluidizing process, the material is stratified, and the compression force and the shearing force are applied to the material. The material is rolled and layered by such forces. Again, the compression force and the shearing force are applied to the material to knead and mix the object material by repeating the rolling and layering. Thus, it is possible to knead the material exactly to meet the theory value and to provide an extremely effective kneader.

Note that in the foregoing embodiment, the technology of kneading has been described mainly. However, the kneading technology can be applied to the mixing apparatus in the same manner as the kneading apparatus. In such a case, the same effect may be ensured.

According to the present invention, the merging and dividing means of the object material passing through each irregular passage is provided between the inlet port and the outlet port of each irregular passage. Furthermore, the direction of each irregular passage is changed mutually so as not to present the straight through-passage from the inlet port to the outlet port of each irregular passage. The diameter of the discharge port of the kneader body is set to be smaller than the diameter of the supply port. Thus, there is no portion where the object material falls directly through the kneader body. In addition, the object material is fluidized under the condition that the kneader body is filled with the object material to thereby obtain substantially the same kneading efficiency as that of the theoretic kneading efficiency. Thus, the kneading efficiency can be remarkably improved. Also, since it is sufficient to simply change the directions of the irregular passages, the adverse effect to the workability can be avoided. Thus, it is possible to improve both the kneading and mixing functions, irrespective of the horizontal arrangement or the vertical arrangement, with a comparatively simple design that does not degrade the workability

INDUSTRIAL APPLICABILITY

The present invention may be applied to a mixer for manufacturing concrete or mortar, or mixing or kneading of two or more kinds of materials that have a fluidizing property or plasticity. Also, since the overall apparatus is simple in structure in comparison with the conventional mixer or the like, the present invention is suitable for the mass production.

I claim:

1. A kneader comprising:

a kneader body having a supply port for supplying an object material at one end and a discharge port at the other end and having a plurality of irregular passages in communication with said supply port and said discharge port, and material supply means for feeding the object material to the kneader body, wherein said kneader body comprises:

a plurality of first and second elements alternately connected to each other, each of said first and second elements having rectangular inlet ports at arranged in parallel relative to each other at a first end of each said first and second elements and rectangular outlet ports arranged in parallel relative to each other at a second end of each of said first and second elements, each of said inlet and outlet ports of the first and second elements communicating with the irregular passages, wherein said outlet ports at the second end of the first element have an arrangement pattern that is rotated approximately 90 degrees about a longitudinal axis of the first element relative to an arrangement pattern of said inlet ports at the first end of the first element, and wherein said outlet ports of the second end of the second element have an arrangement pattern that is rotated approximately 90 degrees about a longitudinal axis of the second element relative to an arrangement pattern of said inlet ports at the first end of the second element, wherein a direction of rotation of the arrangement pattern of said outlet ports of the second element is opposite a direction of rotation of said outlet ports of the first element of the outlet ports of the irregular passages at the other end of the second element, which eliminates the presence of a straight through-passage from said inlet ports of each irregular passage at the first end of the first element to said outlet port of each irregular passage at the second end of the second element, wherein each irregular passage has a sectional shape that progressively varies in a direction from the inlet port toward the outlet port, wherein a connection portion between each first and second element where the inlet port of the each irregular passage of the first element faces the outlet port of each irregular passage of the second element comprises merging and dividing means for merging and dividing the object material passing through each irregular passage, and a diameter of the discharge port of said kneader body is set to be smaller than a diameter of said supply port.

2. The kneader according to claim 1, wherein when said kneader body is arranged vertically such that said supply port is above said discharge port, said material supply means comprising a hopper connected to said supply port, and a conveyor that transports the object material to said hopper.

3. The kneader according to claim 1, wherein said kneader body is arranged horizontally and said material supply means is a pump that pressurizes and feeds the object material to said supply port.

4. The kneader according to any one of claims 1–3, wherein said discharge port comprises a throttle member connected to the outlet port of the irregular passage of either one of the first and second element located at a lowermost end or a rearmost stage.

5. The kneader according to claim 4, wherein said throttle member is cylindrical and has a tapered sectional area in a direction from an opening at one end thereof to an opening at the other end thereof, the opening at the one end is connected to said outlet port of the irregular passage of the element located at the lowermost end or the rearmost stage, and the opening at the other end is opened to form said discharge port.

* * * * *